US005806398A

United States Patent [19]

Emerson et al.

[11] Patent Number: 5,806,398

[45] Date of Patent: Sep. 15, 1998

[54] METHOD AND APPARATUS FOR DETERMING THE NUMBER OF SHEETS IN A STACK

[76] Inventors: Bradley Robert Emerson, 6612 Tholozan, St. Louis, Mo. 63109; Mahlon Taylor Hewitt, 3101 Harlequin La., St. Louis, Mo. 63139

[21] Appl. No.: 651,263

[22] Filed: May 23, 1996

[51] Int. Cl.[6] ..... B26D 5/20

[52] U.S. Cl. ..... 83/522.21; 83/522.29; 83/76.8; 33/775; 33/834; 271/265.04

[58] Field of Search ..... 33/775, 773, 803, 33/804, 805, 833, 834; 271/265.04, 269, 262; 83/76.8, 76.6, 522.21, 522.26, 522.19; 377/8, 20; 340/675; 364/562, 563

[56] References Cited

U.S. PATENT DOCUMENTS

| | | | |
|---|---|---|---|
| 1,083,684 | 1/1914 | Ifkowitsch | 33/775 |
| 2,303,596 | 12/1942 | Zeitlin | 33/778 |
| 2,332,272 | 10/1943 | Shayne | 33/778 |
| 2,493,912 | 1/1950 | Brown | 33/775 |
| 2,799,939 | 7/1957 | Bivans | 33/679.1 |
| 3,118,232 | 1/1964 | Hartsock | 33/810 |
| 3,298,605 | 1/1967 | Bucke et al. | 33/679.1 |
| 3,365,569 | 1/1968 | Hunter | 377/8 |
| 3,808,692 | 5/1974 | Gartner | 33/759 |
| 3,818,327 | 6/1974 | Alexander | 33/501.73 X |
| 3,834,031 | 9/1974 | Muller | 33/549 |
| 3,834,290 | 9/1974 | Nelson | 414/907 X |
| 3,969,826 | 7/1976 | Ottenhues et al. | 33/772 X |
| 3,983,367 | 9/1976 | Kondo et al. | 377/8 |
| 3,996,667 | 12/1976 | Barnard | 33/679.1 |
| 4,189,133 | 2/1980 | Arrasmith et al. | 377/8 X |
| 4,275,264 | 6/1981 | Houck | 33/773 X |
| 4,298,790 | 11/1981 | Decker et al. | 377/8 |
| 4,417,351 | 11/1983 | Williamson et al. | 377/8 |
| 4,426,883 | 1/1984 | Inoue et al. | 33/773 X |
| 4,549,271 | 10/1985 | Nozawa et al. | 33/773 X |
| 4,760,647 | 8/1988 | Gillis | 33/780 |
| 5,027,296 | 6/1991 | Yamaguchi et al. | 364/562 |
| 5,035,064 | 7/1991 | Care | 33/775 X |
| 5,161,313 | 11/1992 | Rijlaarsadam | 33/773 |
| 5,428,557 | 6/1995 | Harbaugh et al. | 364/562 |

OTHER PUBLICATIONS

"Guillotine Cutters: Automation Sharpens Accuracy, Productivity", Debora Toth, Graphic Arts Monthly, Dec. 1993, vol. 65, No. 12, pp. 35–38. (Article includes picture of Prior Art Guillotine Cutter).

*Primary Examiner*—Maurina Rachuba
*Attorney, Agent, or Firm*—Howell & Haferkamp, L.C.

[57] ABSTRACT

A method and apparatus are disclosed for determining the quantity of sheets of material in a stack containing an unknown quantity. The method can be practiced with existing machines which perform various operations on the sheets of material while they are stacked in the machine. An apparatus is disclosed which includes a position sensor in electrical communication with a counter. The position sensor includes a pulse generator to accurately estimate the thickness of a single sheet of material and the height of the stack of material containing an unknown quantity of sheets. The counter includes a processor to perform mathematical calculations using the values measured by the pulse generator and a display for displaying the results.

20 Claims, 4 Drawing Sheets

METHOD AND APPARATUS FOR DETERMING THE NUMBER OF SHEETS IN A STACK

BACKGROUND OF THE INVENTION (1) Field of the Invention

This invention relates generally to a method of and an apparatus for determining the number of sheets in an unknown quantity of sheets of material. Specifically, this invention relates to a method of and an apparatus for determining an unknown quantity of sheets of material which are stacked in a machine for operation thereon by the machine.

(2) Description of the Related Art

Various industries have a need for accurately and quickly estimating the quantity of sheets of material in a stack containing an unknown quantity. For example, in the printing industry, after a load of sheets of material are printed, it is necessary to determine the quantity of sheets which have been printed. This determination is usually performed after the printing process while the printed sheets of material are being collated or prepared for assembly and shipment. Examples of the machines which are used to prepare the sheets of material for assembly and shipment include cutters, hole punchers and trimmers. Each of these machines, as their names suggest, perform certain specific tasks on the sheets of material after the printing process is complete.

During the printing process, a plurality of identical pages of printed material are usually printed on each sheet of material. The pages can contain coupons, pictures, magazine covers or print. The number of pages on each sheet is dependent on the size of each page and the size of each sheet. However, it is not uncommon to include a dozen or more pages on each sheet of material. Therefore, a cutter is used to cut each sheet into twelve separate pages. In addition to cutters, hole punching machines are used to prepare individual pages to be placed in ringed binders and trimmers are used to make each page a uniform length and width. In the printing industry, it is during operation on the sheets of material by these machines that the counting process usually takes place. When a large unknown quantity of sheets of material, referred to as a load, is delivered to an operator, such as on a pallet or in some such similar container, it is the operator's job to stack the sheets in the machine for operation thereon by the machine and in the process estimate the quantity of sheets in the load.

One type of cutter, known in the art as a guillotine cutter, is widely used in the printing industry to cut sheets of material into pages. When performing the cutting, the operator loads the sheets of material onto the bed of the cutter in stacks to cut multiple sheets at one time and thereby decrease the time it takes to cut an entire load. While cutting the sheets, the operator is usually required to estimate the number of sheets of material in each stack and to add successive stacks to estimate the cumulative total of sheets in each load. This process is repeated until the entire load is cut and counted.

In the printing industry, it is imperative that the operator estimate the quantity of sheets of material in each load as accurately as possible because the estimated quantity is used for many different reasons. Preventive maintenance on the cutter may be scheduled based on the number of sheets of material which have been cut. For example, a cutter blade will be sharpened after a predetermined number of sheets are cut. More importantly, accurate estimates are required because customer may pay for the work based on the number of pages produced and often requests a specific number of pages. Providing too many pages results in lost revenue and providing too few pages results in customer complaints. Unfortunately, the prior art methods and devices for counting or estimating the sheets of material in each stack or in a load are cumbersome, expensive and time consuming. The prior art devices usually require an additional step separate from cutting, trimming or hole punching in the process of preparing the sheets of material. This results in increased man-hours, increased repetitive motion for the operator and decreased accuracy which in turn causes loss of revenue or customer dissatisfaction.

One prior art device used for estimating an unknown quantity of sheets of material in a load is commonly referred to as a "stabber." A stabber, shown in FIG. 1, is a hand tool consisting of a handle and two prongs or blades. The distance between the blades is adjustable by loosening a threaded lock on the handle. After adjustment, the threaded lock is tightened to hold the blades in their respective positions. The stabber is used by the operator to pick up stacks of material from the load and place the stacks on a machine. Before beginning, the operator adjusts the stabber blades to a predetermined width so that the distance between the blades approximates the height of a known quantity of sheets. In order to adjust the blades of the stabber in the fashion, the operator manually counts a known quantity of sheets of material, loosens the threaded lock and places the stabber blades above and beneath the known quantity of sheets. The threaded lock is then tightened and the distance between the stabber blades is used to estimate the height for the known quantity of sheets. As shown in FIG. 1, the operator pushes the stabber blades into the load with the top blade on top of the load and the lower blade entering the load at the predetermined distance from the top blade. The operator picks up successive stacks of material from the load, each stack filling the distance between the blades, and places the stacks on the machine. By remembering or recording the number of stacks placed on the machine, the operator can thereby estimate the quantity of sheets in the load.

The stabber has numerous problems due to its design and method of use. In order to make the stack height large enough to significantly reduce the successive number of stacks the operator is required to lift, the operator is required to manually count a very large number of sheets when first setting the distance between the stabber blades. However, the stack must also be small enough so that the operator can manually lift each stack. Therefore, the height of the stack which is used to first set the stabber blades is limited. The stabber blades also tend to damage the edges of the sheets of material because the stabber must be forced into the load each time a stack of material is taken from the load. The stabber requires repetitive operator movement which increases the time to place the material into the machine. Due to the limited width that the stabber blades can be spread, it is difficult to reduce the amount of repetitive motion. Repetitive motion is known to cause operator injury and fatigue. Moreover, in order to obtain an accurate estimate, an operator must maintain a cumulative total of the number of stacks loaded onto the machine. This requires the operator to remember or record the number of stacks which increases the time to complete a load. Lastly, due to fluff in a load between the sheets some of the stacks have heights equal to the distance between the blades but do not contain the estimated quantity of sheets. For example, the sheets toward the bottom of a load tend to be more firmly pressed together due to the weight of the sheets above them. This results in additional inaccuracies.

Another prior art device used to estimate the quantity of sheets in a stack is a scale. When using a scale, the operator places a known number of sheets of material on the scale to obtain the weight of a single sheet. After the single sheet weight is known, the operator places successive unknown quantities of sheets of material on the scale to obtain the cumulative weight of a stack of material. After obtaining the cumulative weight, the operator divides the cumulative weight by the previously measured weight of the single sheet to estimate the quantity of sheets stacked on the scale. After completing this process, the operator then takes the sheets of material from the scale and places them on the machine.

Because, the scale is an additional machine which must be included in the printing process, separate from the cutter, hole-puncher or trimmer, it takes up additional space and increases costs. A scale also requires the operator to move each sheet of material twice, once to the scale and a second time to the cutter. This increases repetitive movement and therefore increases time, operator fatigue and chance of injury. Moreover, due to the additional movement and work required, operators tend to weigh only one stack and approximate additional stacks that the operator believes are equal to the first stack weighed. Of course, this leads to additional inaccuracies.

An additional prior art device is known as a sheet counter. A sheet counter uses forced air to separate the individual sheets in a stack and sequentially counts each sheet while the sheets are separated. Like a scale, the sheet counter is a separate machine and requires additional repetitive motion. In addition, the cost of a sheet counter is prohibitively expensive such that this device is only used in applications which require an exact count of the sheets, such as currency.

SUMMARY OF THE INVENTION

The inventors herein have overcome these and other problems of the prior art by providing for a method of and an apparatus for determining the number of sheets of printed material in a stack without additional machines and without increased operator movement. The present invention can be removeably attached to, or built into, any number of existing machines including cutters, trimmers and hole-punchers and provides an accurate estimate of the quantity of sheets of material in a stack.

The invention can best be understood by describing its operation on a guillotine cutter. As known in the art, A guillotine cutter is used to cut individual printed pages from large sheets of material. The guillotine cutter has a bed for receiving the sheets of material for cutting. The bed of the cutter is a wide flat surface which accommodates placement of the stack of material thereon. A guillotine cutter includes a blade which extends the entire length of the bed and moves vertically in a range extending from the bed to a predetermined height above the bed. The predetermined height fixes the allowable height of a stack which can be placed on the bed.

In order to firmly hold the stack of material in place during cutting, a guillotine cutter also includes a clamp. The clamp is a movable weight which can be raised or lowered in the same direction as the blade and is located directly behind the blade. The clamp is moveable from a first position resting directly on the bed to a second position resting on top of the stack of material inserted beneath the raised clamp when the stack of material is on the bed. The clamp can be raised continuously from a first position resting on the bed to a second position resting on a stack of material. The second position can be any height above the bed, up to the maximum height of a stack that will pass beneath the raised cutter, to accommodate stacks of material with different heights.

The present invention utilizes a position sensor coupled to the clamp so that the displacement of the clamp above the bed can be measured. Due to the weight of the clamp, the distance between the bed and the clamp, when the clamp is moved to its second position, is substantially equal to the height of the stack of material. The weight of the clamp pushes the sheets in the stack firmly together and therefore removes any fluff which may have occurred when the stack was moved from the load to the bed. Therefore, clamp displacement above the bed when the clamp is in its second position gives an accurate estimate of the height of the stack of material. The height of the stack of material can be used to determine the approximate thickness of each individual sheet of material when a known number of sheets are in the stack. Once the individual sheet thickness is determined, the number of sheets of material in a stack having an unknown quantity can be determined by dividing the sheet thickness into the height of the stack having an unknown quantity of sheets.

Because the sheets of material are usually very thin, accurately determining an individual sheet thickness is difficult. The present invention provides an accurate measurement of very thin sheets by utilizing a position sensor which has the capability to discern very small increments of clamp displacement. This is accomplished in the preferred embodiment by utilizing a pulse generator. A pulse generator, as is known in the art, converts mechanical rotation of a shaft into a series of electrical pulses proportional to the degree of rotation. By attaching a measuring wheel to the pulse generator shaft, very small distances can be accurately quantified. In the preferred embodiment, the measuring wheel is mechanically coupled to the clamp of a machine such as a guillotine cutter. In this way, very small movement of the clamp results in the generation of a position output signal, comprised of electrical pulses, which can be processed by a counter to provide an accurate measurement of very modest clamp displacement.

The preferred embodiment includes a counter in electrical communication with the pulse generator, to receive the position output signal from the pulse generator and convert the position output signal into a numerical value. The counter displays the numerical value in a visual display such as an LED display. The counter in the preferred embodiment also includes a processor for mathematical manipulation of the numerical value. For example, the processor includes an input keypad for inputting a scaling factor into the processor to rescale the numerical value. By resealing the numerical value, an operator can calibrate the counter to increase the numerical value by one each time a requisite number of pulses is received from the pulse generator. In this way, the numerical value in the LED display can be rescaled to represent the number of sheets below the clamp instead of the number of pulses received. This simplifies the use of the present invention making it more user friendly.

In operation, the position sensor is attached to a machine, such as a cutter, so that the measuring wheel of the pulse generator is mechanically coupled to the clamp. In this configuration, as the clamp is moved the measuring wheel rotates the shaft of the pulse generator causing electrical pulses to be transmitted to the counter. For a particular number of electrical pulses received, the counter processor increases a numerical value in the LED display. The counter can be placed on top of the machine or near the machine where the LED display can be viewed by the operator.

After attaching the pulse generator, the method of the present invention is exercised as follows. The operator moves the clamp to its first position, resting directly on the bed of the cutter. The operator then resets the counter using the input device so that the numerical value in the visual display of the counter is zero. The operator then raises the clamp and places a known quantity of sheets of material on the bed of the cutter. The operator then lowers the clamp onto the known quantity of sheets of material causing a position output signal, including electrical pulses from the pulse generator to be received by the counter. The counter displays a numerical value representing the number of pulses in the position output signal. The numerical value, a first clamp displacement, represents the displacement of the clamp above the bed due to the known quantity of sheets of material.

The operator views the first clamp displacement displayed in the LED display and calculates a scaling factor which will convert the first clamp displacement to a number approximately equal to the known quantity of sheets on the bed. For example, if the operator places 25 sheets of material on the bed and, after lowering the clamp onto the 25 sheets of material, the first clamp displacement is 100, the operator calculates a scaling factor by dividing the first clamp displacement (100) by a divisor to convert the first clamp displacement into the known quantity of sheets (25). In this example, the scaling factor is ¼.

The operator inputs the calculated scaling factor, equivalent to the first clamp displacement divided by the known number of sheets, into the counter and the processor applies the scaling factor to the first clamp displacement. After inputting the scaling factor, the numerical value in the LED display equals the known number of sheets. In this way, the operator can be certain that the counter is calibrated to increase the numerical value shown in the LED display by 1 for each clamp displacement distance equivalent to the thickness of one sheet of material. The calibration need not be repeated for each load, but remains until sheets made of a different type of material are to be cut, or the sheet size changes. An alternative allows the calculation of the scaling factor to be performed by the processor with the operator merely inputting the known number of sheets. Also, the entire process can be automated by requiring a predetermined number of sheets to be placed in the machine during calibration and using software to program the processor. After calibrating the counter, the operator raises the clamp and places as many sheets of material on the bed as the machine will allow, quantity unknown. The clamp is again moved to its second position, on top of the stack of material having an unknown quantity, causing a second clamp displacement to be sent to the counter. The scaling factor is applied to the second clamp displacement by the processor thereby causing the determined number of sheets of material in the stack to be displayed in the LED display.

The present invention can be attached to any existing machine having a component comparable to the clamp of a guillotine cutter and can also be incorporated into new machines. A stand-alone counter can also be provided incorporating the present invention to provide counting capability even if there is no need for a cutter, trimer or the like. Moreover, because most modern cutters already contain a processor and display, the present invention can be practiced by adding a position sensor to an existing cutter and electrically transmitting the position output signal to the processor. The method and apparatus of the present invention allow an accurate determination of an unknown quantity of sheets of material without the need for an additional machine. Moreover, the present invention decreases repetitive movement by the operator and increases throughput of material over the prior art. Another problem overcome in the prior art is the removal of the "fluff" from the stack of material due to the pressure on the stack of material by the clamp. The present invention provides an "in-line" counting method having no additional physical demand on the operator. Moreover, the present invention can be utilized as a data collection point by compilation of cumulative totals of sheets operated on by a particular machine.

While the principal advantages and features of the present invention have been described above, a more complete and thorough understanding and appreciation for the invention may be attained by referring to the drawings and description of the preferred embodiment which follow.

DETAILED DESCRIPTION OF THE PREFERRED EMBODIMENT

Figure 2:
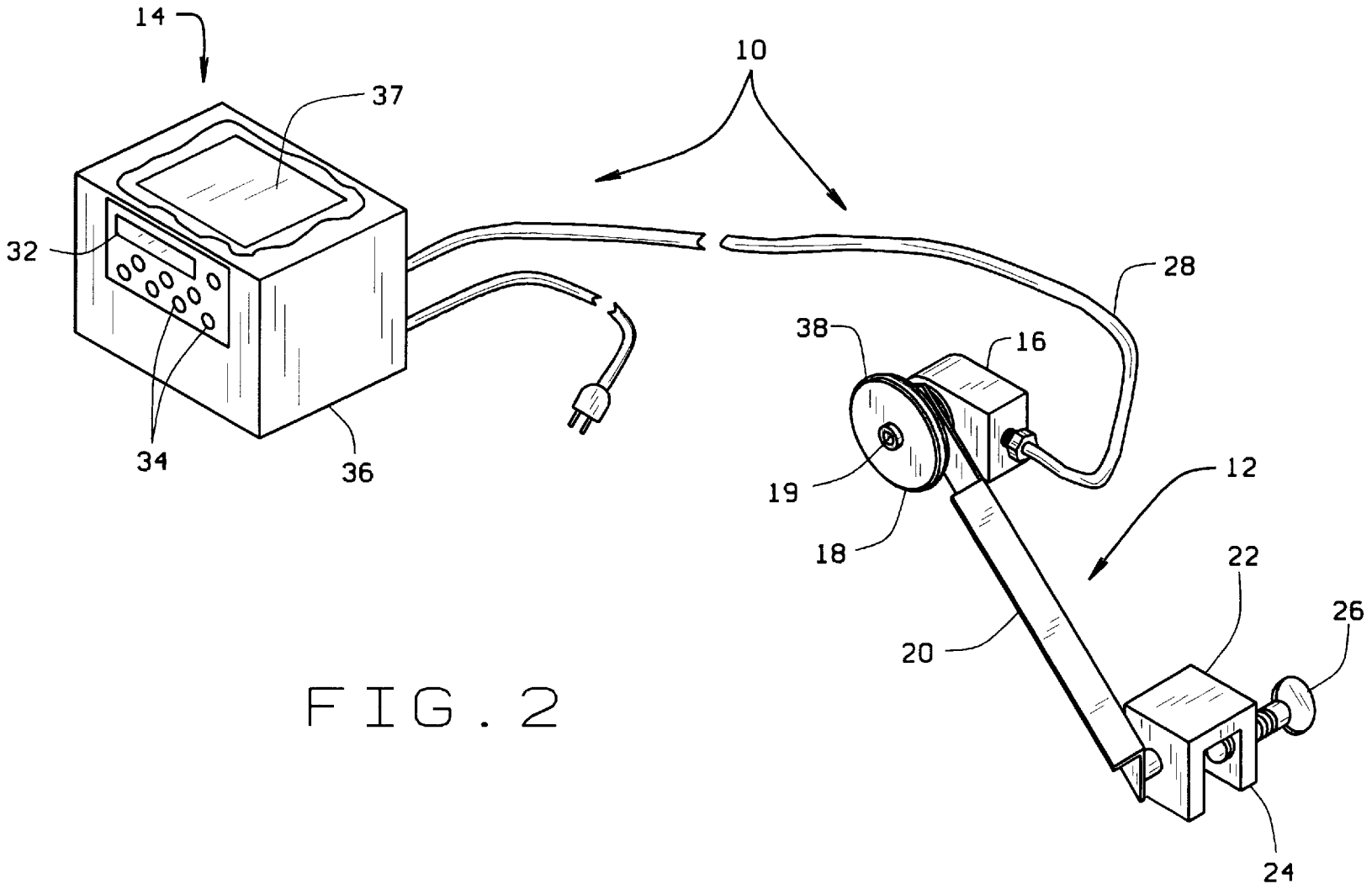
FIG. 2 is a perspective view of the position sensor and counter of the preferred embodiment.

The preferred embodiment of the present invention is shown generally as 10 in FIG. 2. The preferred embodiment includes a means for producing a position output signal comprising a position sensor 12 in electrical communication with a means for determining a number of sheets of material from the position output signal which comprises a counter 14. The position sensor 12 includes a pulse generator 16 attached to a measuring wheel 18 together comprising a pulse generator assembly. The pulse generator 16 has a shaft 19 positioned through channel member 20. The channel member 20 of the preferred embodiment is a length of angle modified at one end for insertion of the pulse generator shaft 19 therethrough. The measuring wheel 18 is attached to the pulse generator shaft 19. The other end of the channel member 20 is attached to a connector 22. The connector 22 allows the pulse generator assembly to be removably attached to an existing machine thereby allowing an existing machine to be retro-fitted.

The connector of the preferred embodiment includes a thumb-screw fastener 24 and a thumb-screw 26. However, any type of connector is acceptable and there are many available and widely known fasteners which could be used to attach the pulse generator assembly to the machine. In addition, the connector is only one means to rigidly affix the pulse generator assembly to a machine. Welding, riveting or any other type of fastening which provides a rigid affixation of the pulse generator assembly to the machine is acceptable. The pulse generator 16 includes an electrical cable 28 for operatively connecting the pulse generator to the counter 14. The counter includes an LED display 32 and input keys 34 contained in a utility enclosure 36. The counter also includes a processor 37 within the utility enclosure 36.

The pulse generator 16, as is known in the art, is an incremental encoder which converts shaft rotation into a position output signal. The position output signal contains information from which the direction of shaft movement can be determined. A pulse generator may utilize a light source and a sensor array in conjunction with a shaft-mounted metal etched encoder disk, a series of magnets and a magnetic field measuring device or any other well known and widely available devices. The pulse generator 16 of the preferred embodiment is a model RPGQ Quadrature Output Rotary Pulse Generator manufactured by Red Lion Controls of York, Pa. However, any type of position sensor would be acceptable provided small increments of displacement can be quantified. For example, a magnetic positioning device or a laser positioning device would also be acceptable as the position sensor 12. A mechanical counter driven by a mechanical gears would also be as acceptable alternative.

The measuring wheel of the preferred embodiment is a model WF10000R manufactured by Red Lion Controls of York, Pa. When used with the pulse generator referenced above, this results in 41.666 pulses per inch of wheel travel or 1.3888 pulses per degree of rotation of the pulse generator shaft 19. As is understood in the art, the accuracy of measurement is dependent on the size of the measuring wheel and the quality of coupling between the measuring wheel and the measured object. For example, increasing the number of pulses per revolution and decreasing the size of the measuring wheel increases accuracy. Alternative embodiments of the present invention include pulse generators readily available which are capable of generating 1200 or more pulses per revolution. Also, alternative measuring wheels of smaller diameter are available. In order to increase the frictional engagement between the measuring wheel 18 and a machine, a rubber washer 38 is positioned around the circumference of the measuring wheel 18. However, in the alternative, a rubber strip may be attached to the surface to be measured.

The counter 14 of the preferred embodiment is a model GEM10000 and the utility enclosure 36 is a NEMA1 enclosure, both manufactured by Red Lion Controls of York, Pa. As is known in the art, a counter 14 contains a processor 37 having a means for converting the electrical pulses generated by the pulse generator 16 into a numerical value which is displayed on the LED display 32. The numerical value can also be stored in the memory of the processor 37 and the processor includes logic to perform mathematical manipulations to the numerical value.

The preferred embodiment of the invention is practiced by adding the combination of the position sensor 12 and counter 14 to an existing machine such as a cutter, hole-puncher or trimmer. The combination of the position sensor 12 and the counter 14 can be attached to a number of different machines to provide a means for determining a quantity of sheets of material in a stack to be operated on by the machine. All that is required is that the particular machine have a moveable component that can be coupled to the position sensor 12 to measure displacement of the component when the component is moved onto a stack of material from a point below the stack.

Figure 3:
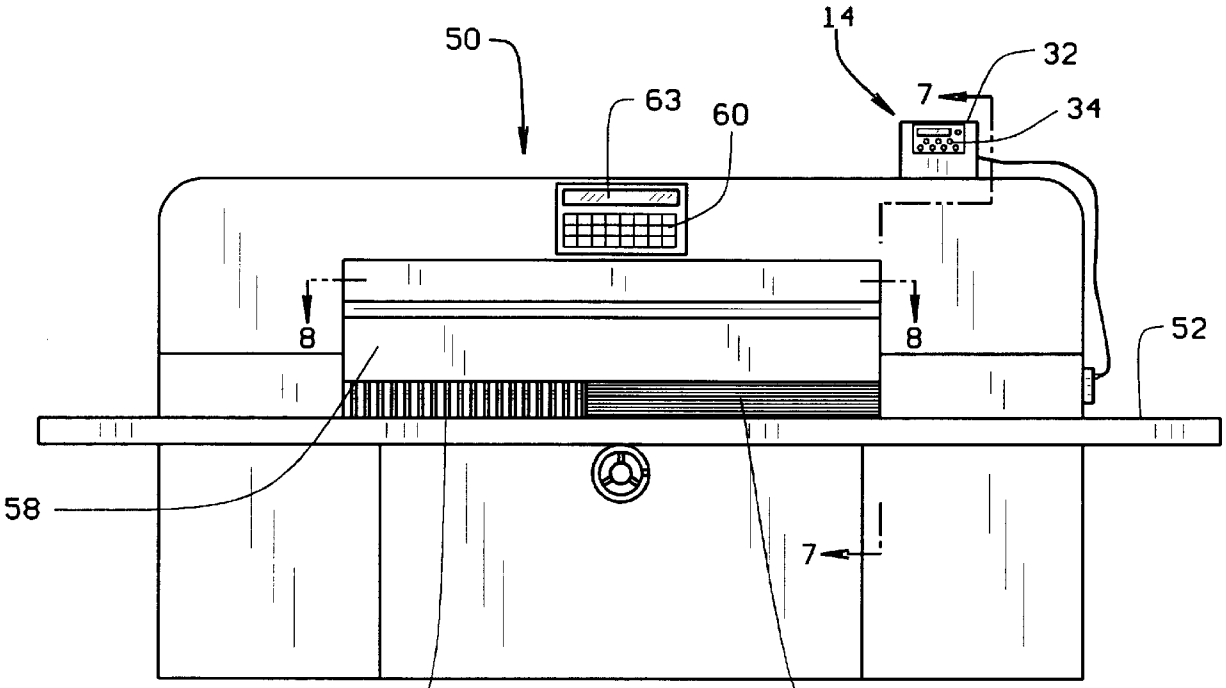
FIG. 3 is a front view of a guillotine cutter showing the present invention attached thereto.
Figure 4:
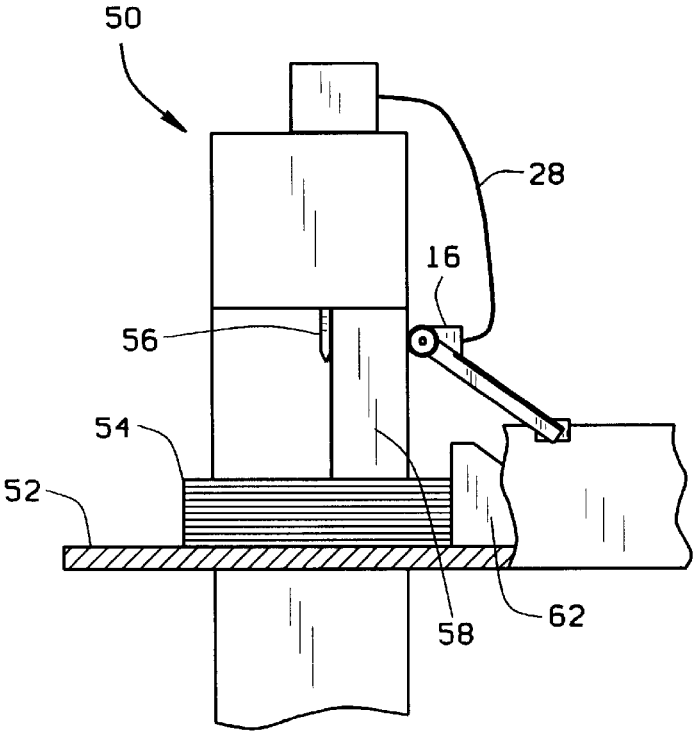
FIG. 4 is a side sectional view of a guillotine cutter through line 7—7 of FIG. 3, showing the present invention attached thereto.
Figure 5:
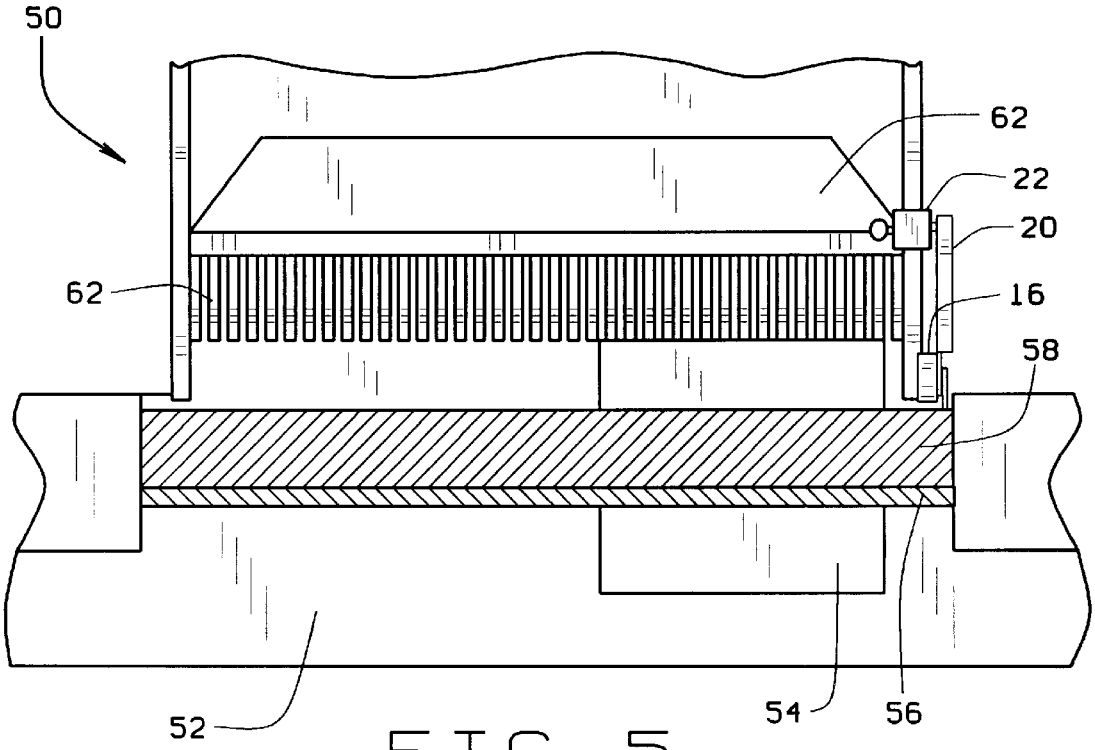
FIG. 5 is a top sectional view of a guillotine cutter through line 8—8 of FIG. 3 showing the present invention attached thereto.

Application of the preferred embodiment to a machine can best be understood by describing the invention attached to a guillotine cutter. A guillotine cutter, as is known in the art, is shown generally as 50 in FIGS. 3–5. FIG. 3 is a front view of a guillotine cutter. FIG. 4 is a side sectional view of the guillotine cutter taken at line 7—7 of FIG. 3. FIG. 5 is a top sectional view of the guillotine cutter taken at line 8—8 of FIG. 3. The features of the guillotine cutter will be described with reference to FIGS. 3–5. A guillotine cutter (hereinafter "guillotine cutter" or "cutter") as shown in FIGS. 3–5, includes a bed 52 for receiving a stack of material 54 thereon. The stack of material 54 is placed on the bed 52 of the cutter 50 for cutting by a blade 56.

The blade 56 moves up and down but is stationary with respect to its distance from the front and back of the cutter. The blade 56 can be raised and lowered from the bed 50 to a predetermined height. The cutter 50 also includes a clamp 58. The clamp 58 is a heavily weighted object which holds the stack of material 54 firmly in place during cutting. The weight or pressure is usually provided through a spring or hydraulic cylinder. As shown in FIGS. 4 and 5, the blade 56 is positioned in front of the clamp 58. The clamp 58 is moveable from a first position resting directly on the bed 52 to a second position resting on the top of the stack of material 54. A cutter usually includes an alpha-numeric keypad 60 and an LED display 63 and a means for transmitting comprising data cables for the operator to input control commands to a processor and to view system messages regarding operation of the cutter 50. The keypad 60 facilitates the entry of control commands for proper placement of the stack of material 54 below the blade 56. The proper placement of the stack of material 54 is accomplished by moving a back gauge 62 as further explained below.

A stack of material 54 consisting of an unknown quantity of individual sheets is placed on the bed 52. Each individual sheet may contain a plurality of individual identical printed pages (not shown). In order to separate each page, each sheet of material must be cut several times. The exact placement of the cut on the sheet depends upon the number of pages on each sheet as well as the size of each page. The operator uses the keypad 60 to facilitate placement of the stack of material with respect to the blade 56 by moving the back gauge 62 after placing the stack of material 54 on the bed 52 and in front of and abutting the back gauge 62. The back gauge 62 moves across the bed 52 perpendicular to the front and back of the cutter beneath the blade 56. The back gauge 62 can be moved before or after the stack of material 54 is placed on the bed. The operator enters the desired position of the back gauge into the cutter 50 through the keypad 60. By properly moving the back gauge 62 the operator can be sure of proper placement of the stack of material in the horizontal plane below the blade 56 and this facilitates precision cutting by the cutter 50.

Figure 1:
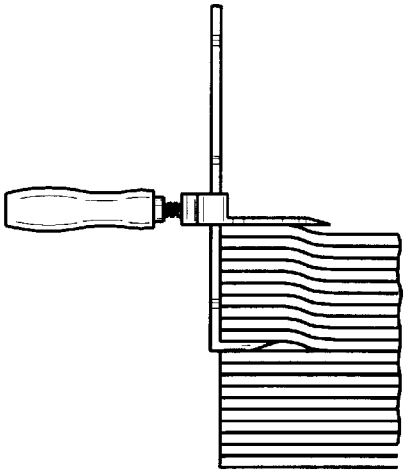
FIG. 1 PRIOR ART
FIG. 1 shows a prior art stabber device being used to count a 10 sheet stack of material from a load of sheets.

The method of operation of the guillotine cutter by an operator is as follows. The stack of material 54 is placed on the bed 52. The operator programs the guillotine cutter, using the keypad 60 to send commands to the cutter processor, to position the back gauge 62 for the particular job to be cut. A guillotine cutter operator would pick up successive stacks of material from a load of material using a stabber (FIG. 1) and place the stacks on the bed 52 of the cutter 50. The sheets of material in the stack must remain flush against the back gauge 62 to ensure precision cutting. If necessary, the back gauge can be repositioned after the stack of material is placed on the bed because the back gauge has sufficient power to move a stack of material. Once the stack of material 54 is in the proper position beneath the blade 56, the operator moves the clamp 58 on the stack of material 54 to hold the stack while cutting and lowers the blade 56 to complete the cut. The clamp 58 is heavily weighted to hold the stack of material firmly in place. After each cut, the stack of material is moved by the back gauge 62 to position the stack of material 54 for subsequent cuts by the blade 56.

The preferred embodiment is described in combination with a guillotine cutter 50. However, it is understood that the present invention is not limited to guillotine cutters nor cutters in general. The method and apparatus of the present invention can be incorporated into a stand-alone counter machine by adding to the pulse generator 16 and counter 14 combination to a moveable clamp which can be used to measure the height of the stack. The present invention can also be included with any machine having a component comparable to the clamp 58 and bed 52 of the cutter as described above. The present invention can also be added to an existing cutter by the addition of a position sensor and processor logic to process the position output signal.

Figure 6:
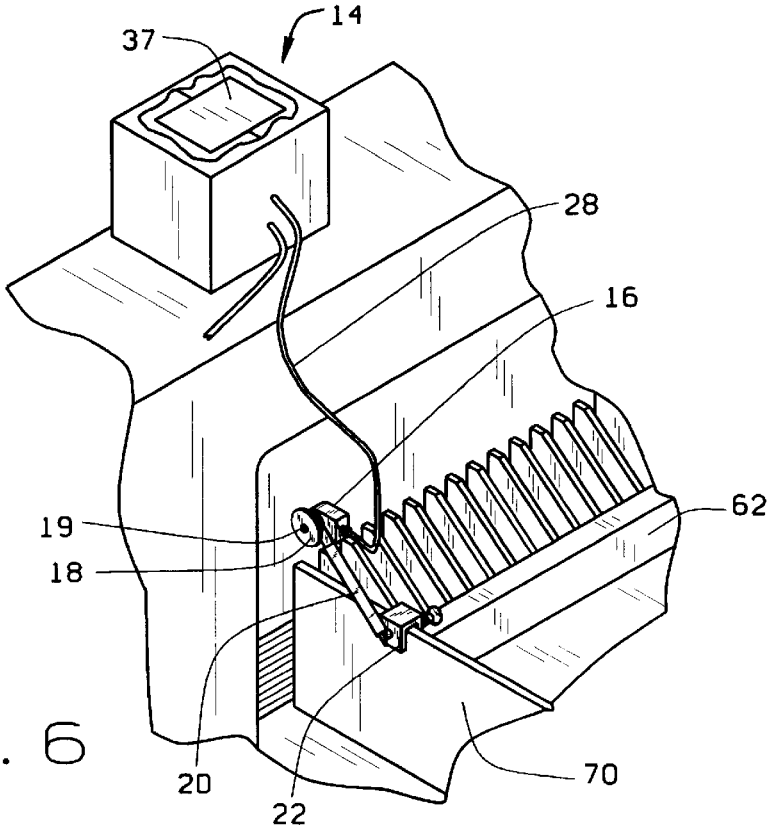
FIG. 6 is a close-up cutaway section of the present invention attached to the guillotine cutter of FIG. 3.
Figure 7:
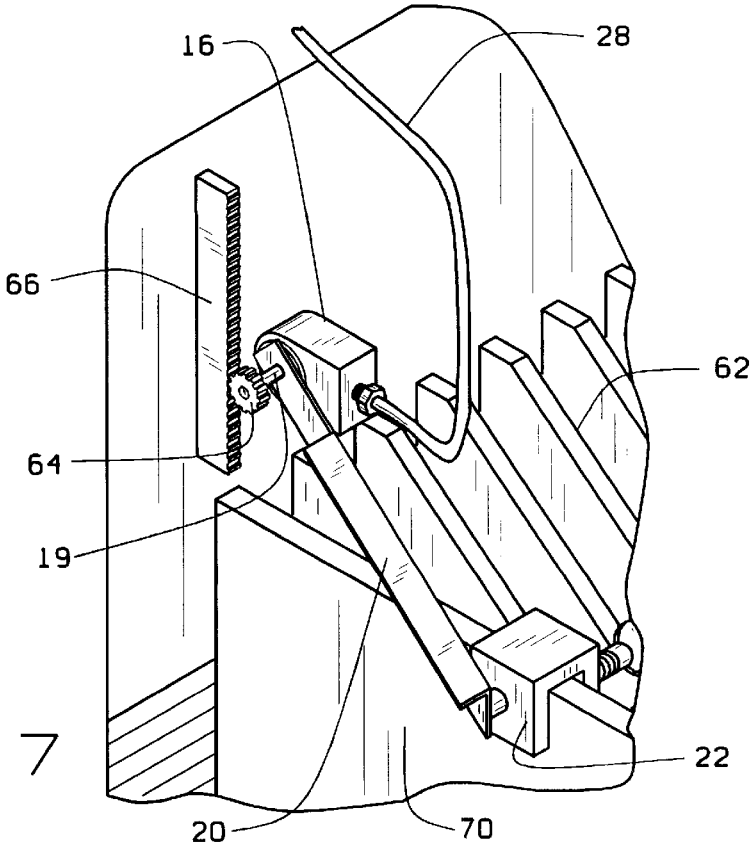
FIG. 7 is a close-up cutaway section of a position sensor attached to the guillotine cutter of FIG. 3 showing the use of a rack and pinion as a means to mechanically couple the position sensor to the clamp.

The attachment of the position sensor 12 to the guillotine cutter 50 is shown in FIGS. 6 and 7. The pulse generator 16 is mechanically coupled to the clamp 58 by attaching the connector 22 to the machine so as to allow the measuring wheel 18 to contact the clamp 58. In an alternative embodiment, shown in FIG. 7, the pulse generator shaft 19 can be attached to a pinion 64 and a rack 66 can be affixed to the clamp 58 for engagement by the pinion 64. Any type of position sensor which can accurately measure a small clamp displacement by the clamp is acceptable. What is required is the level of accuracy be sufficient to discern clamp movement of a distance equivalent to the thickness of a single sheet. Thinner sheets demand additional discernment. For example, an alternative embodiment which does not require significant precision could include the use of mechanical gears coupled to the clamp which turn a mechanical odometer as the gears are rotated by clamp movement. For increased accuracy, magnetic sensors or laser operated position measurement devices as are known in the art could be utilized.

The pulse generator 16 of the preferred embodiment includes an electrical cable 28 to transmit the position output signal from the pulse generator 16 to the counter 14. Numerous types of counters acceptable for the present invention are widely known and readily available. The counter 14 in the preferred embodiment includes an LED display 32 for displaying a numerical value representing the number of pulses generated. The counter 14 also includes a processor 37 having a means for calculating comprising a calculator which allows mathematical manipulation of the numerical value. In this way, the numerical value can be scaled before or after being displayed. The counter 14 also includes an input device, such as a keypad 34 which allows the operator to input a scaling factor to be mathematically applied to the numerical value. This is useful for calibrating the measuring wheel to the particular application with which it is being used.

Referring to FIGS. 6 and 7, the counter 14 is in electrical communication with the pulse generator 16. The counter 14 can be placed on top of the cutter or anywhere which allows the operator to view the LED display 32. The pulse generator 16 is secured to one end of the channel member and the shaft 19 is positioned through the end of the channel member 20. The measuring wheel 18 attached to the pulse generator shaft 19 is mechanically coupled to the clamp 58. At the opposite end of the channel member 20 the connector 22 removeably attaches the pulse generator to an existing machine 70.

In this configuration, movement of the clamp 58 rotates the measuring wheel 18 which in turn rotates the pulse generator shaft 19 causing electrical pulses to be generated. The position output signal, comprising various electrical pulses, is sent through the electrical cable 28 to the counter 14. The counter processor 37 processes the position output signal and transmits the number of pulses as a numerical value to the LED display 32. In this fashion, the movement of the clamp is quantified and this information can be manipulated to determine the number of sheets of material stacked in the machine.

The use of the present invention with a cutter 50 operates as follows. The bed 52 of the cutter 50 is cleared. The clamp 58 is moved to a first position resting directly on the bed 52 where the stack of material 54 is to be placed. The counter 14 is then reset to cause the LED display 32 to read a predetermined number, such as zero. The clamp 58 is raised and in the process of being raised, the clamp 58 rotates the measuring wheel 18 which rotates the pulse generator shaft 19 causing electrical pulses to be generated and sent to the counter 14 as a position output signal representing clamp displacement above the bed. The counter 14 receives the position output signal and increases the number in the LED display 32 from the reset value.

A known number of sheets of printed material is then placed on the bed 52 of the cutter 50, for example, twenty-five sheets. The clamp 58 is then moved to the second position resting on the twenty-five sheets thereby causing the measuring wheel 18 and pulse generator shaft 19 to rotate. This causes a position output signal to be transmitted and processed by the counter 14 thereby decreasing the number displayed by the LED 32 as the clamp 58 is lowered. After the clamp 58 is moved into its second position, on top of the twenty-five sheets, the numerical value on the LED display 32 equals the first clamp displacement. The first clamp displacement represents the position output signal received by the counter due to displacement of the clamp 58 from its first position on the bed 52, to its second position on top of the twenty-five sheets.

Once the first clamp displacement is displayed and viewed by the operator, the operator enters a scaling factor into the counter through input keys 34 to convert the first clamp displacement to equal the known number of sheets in the printer (twenty-five). This is accomplished by dividing the numerical value in the LED display 32 by an appropriate divisor to convert the numerical value in the LED display 32 to equal the known quantity of sheets stacked on the bed. For example, if the LED display 32 reads one-hundred after the clamp 58 is moved to the second position, on top of twenty-five sheets, a scaling factor of 1/4 is input to the counter, so that the numerical value displayed in the LED display 32 equals twenty-five, the known number of sheets.

Thereafter, the clamp 58 is raised and a stack of material 54, quantity unknown, is stacked on the bed 52. The clamp 58 is again lowered to its second position now resting on top of the stack of material 54 having an unknown quantity. This results in the pulse generator sending to the counter a position output signal representing the second clamp displacement. The second clamp displacement is the displacement of the clamp above the bed resulting from the stack of material 54 having an unknown quantity of sheets therein. Having previously calculated and entered the scaling factor into the counter 14, the processor applies the scaling factor to the second clamp displacement resulting in a numerical value equal to the determined quantity of sheets in the stack of material 54 to be displayed on LED display 32. The processor 37 of the preferred embodiment includes a memory for storing a plurality of numerical values thereby keeping a cumulative total as well as means for applying the scaling factor to the stored and displayed numerical values. In this way, the counter 14 can be used to store a cumulative running total of the quantity of sheets in each stack of materials to thereby determine the total number of sheets in the load.

The present method and apparatus can be used in a variety of different machines for determining the number of sheets of material in a stack. Various types of other machines are known in the art such as hole punchers or trimmers which operate on a stack of material. Any type of machine which has a moveable part capable of movement from a first position, in the location on the machine where the stack of material is to be placed, to a second position, on the stack of material, can be retro-fitted to use the method and apparatus of the present invention. What is required is that a moveable part on the machine be coupled to a position sensor so that the distance moved by the moveable part can be quantified. Thereafter, operation of the present invention is straightforward and can be applied in the same fashion as described above for a guillotine cutter.

In an alternative embodiment, a separate machine can be built using the aspects of the present invention to provide for a stand-alone counter. The counter can be used to determine the quantity of sheets in any stack of material without requiring the machine to operate on the material. Again, what is required is that the machine be capable of measuring the thickness or height of the stack of material as well as a means for quantifying the thickness of a single sheet. This is accomplished by providing a bed, a clamp, a position sensor and a counter.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. An apparatus for determining a number of sheets stacked in a machine, the machine having a bed for placement of the stack thereon and a clamp, moveable from a first position resting directly on the bed to a second position resting on top of the stack when the stack is on the bed, the apparatus comprising:

a position sensor coupled to the clamp, the position sensor having means for producing a position output signal wherein the means for producing the position output signal is responsive to actual movement of the clamp and the position output signal represents a distance travelled by the clamp when the clamp is moved from the first position to the second position; and a counter operatively connected to the position sensor to receive the position output signal, the counter having means for determining a number of sheets from the position output signal.

2. The apparatus of claim 1 wherein the means for producing a position output signal includes a pulse generator mechanically coupled to the clamp and the position output signal is a series of electrical pulses numerically proportional to the distance travelled by the clamp when the clamp is moved from the first position to the second position.

3. The apparatus of claim 2 wherein the counter includes a processor adapted to convert the series of electrical pulses into a counter output signal representative of a numerical value approximating the determined quantity of sheets in the stack.

4. The apparatus of claim 3 further comprising a visual display in electrical communication with the counter, for receiving the counter output signal and displaying the numerical value.

5. The apparatus of claim 4 wherein the counter further comprises an input device for inputting a scaling factor into the processor, and the processor includes means for calculating the numerical value from the scaling factor and the position output signal.

6. The apparatus of claim 3 wherein the counter includes a memory for storing the numerical value.

7. The apparatus of claim 1 wherein the position sensor further comprises a wheel in frictional engagement with the clamp.

8. The apparatus of claim 7 wherein the position sensor further comprises a strip of frictional material placed between the wheel and the clamp to enhance the frictional engagement between the wheel and the clamp.

9. The apparatus of claim 1 wherein the position sensor further comprises:

a pinion; and a rack affixed to the clamp for engaging the pinion.

10. The apparatus of claim 1 further comprising a connector attached to the position sensor for removeably attaching the position sensor to the machine thereby allowing an existing machine to be retro-fitted.

11. A method of determining a number of sheets in a machine, the machine having a bed for receiving a stack of sheets, and a clamp moveable from a first position resting directly on the bed to a second position resting on the stack when the stack is on the bed, the method comprising the steps of:

measuring a first clamp displacement substantially equal to a first distance between the bed and the clamp when a known quantity of the sheets are placed on the bed and the clamp is in the second position on the known quantity of sheets;

calculating a scaling factor to convert the first clamp displacement into a numerical value representing the known quantity of sheets;

measuring a second clamp displacement substantially equal to a second distance between the bed and the clamp when the number of sheets is placed on the bed and the clamp is in the second position on the number of sheets; and applying the scaling factor to the second clamp displacement to determine how many sheets are in the stack.

12. The method of claim 11 wherein the step of calculating the scaling factor includes dividing the first clamp displacement by the known quantity of sheets.

13. The method of claim 11 performed using a position sensor coupled to the clamp, the position sensor having means for producing a position output signal representing a distance travelled by the clamp when the clamp is moved from the first position to the second position, wherein the step of measuring a first clamp displacement includes the steps of:

placing a known quantity of sheets on the bed;

moving the clamp to the second position on top of the known quantity of sheets; and calculating the first clamp displacement from the position output signal produced by the position sensor.

14. The method of claim 13 wherein the step of measuring a second clamp displacement includes the steps of:

stacking the unknown quantity of sheets on the bed;

moving the clamp to the second position on top of the unknown quantity of sheets; and calculating the second clamp displacement from the position output signal produced by the position sensor.

15. The method of claim 14 performed using a counter operatively connected to the position sensor, the counter having means for determining a number of sheets of material from the position output signal.

16. The apparatus of claim 1, further comprising:

a guillotine cutter having a bed, a clamp and a processor wherein the position sensor is coupled to the clamp.

17. The apparatus of claim 16 wherein the means for determining a number of sheets from the position output signal includes a pulse generator mechanically coupled to the clamp and wherein the position output signal is a series of electrical pulses numerically proportional to the distance travelled by the clamp when the clamp is moved from the first position to the second position.

18. The apparatus of claim 17 further comprising means associated with the processor for converting the series of electrical pulses into a numerical value approximating the determined quantity of sheets in the stack.

19. The apparatus of claim 18 wherein the guillotine cutter includes a visual display, the apparatus further comprising means associated with the processor for transmitting the numerical value from the processor to the visual display.

20. The apparatus of claim 1, further comprising, at least one clamp moveable from a first position to a second position wherein the distance between the first position and the second position is representative of the height of the stack of material and the position sensor is coupled to the clamp.

* * * * *

UNITED STATES PATENT AND TRADEMARK OFFICE

CERTIFICATE OF CORRECTION

PATENT NO. : 5,806,398

DATED : Sep. 15, 1998

INVENTOR(S) : Emerson, et al

It is certified that error appears in the above-indentified patent and that said Letters Patent is hereby corrected as shown below:

On the title page, item [54] and column 1, line 2
In the title please replace "Determing" with -- Determining --.

Signed and Sealed this

Fifteenth Day of December, 1998

*Attest:*

Bruce Lehman

BRUCE LEHMAN

*Attesting Officer*

*Commissioner of Patents and Trademarks*